US007631461B2

(12) United States Patent
Shadwell et al.

(10) Patent No.: US 7,631,461 B2
(45) Date of Patent: Dec. 15, 2009

(54) ROOFING PRODUCT POSSESSING THERMAL EXPANSION RELIEF CHARACTERISTICS

(75) Inventors: Peter J. Shadwell, Carl Junction, MO (US); Travis W. Turek, Webb City, MO (US)

(73) Assignee: Epoch Composite Products, Inc., Joplin, MO (US)

( * ) Notice: Subject to any disclaimer, the term of this patent is extended or adjusted under 35 U.S.C. 154(b) by 580 days.

(21) Appl. No.: 11/463,445

(22) Filed: Aug. 9, 2006

(65) Prior Publication Data

US 2008/0034699 A1 Feb. 14, 2008

(51) Int. Cl.
*E04B 1/00* (2006.01)
*E04D 1/00* (2006.01)

(52) U.S. Cl. ..... 52/98; 52/525

(58) Field of Classification Search ..... None
See application file for complete search history.

(56) References Cited

U.S. PATENT DOCUMENTS

| | | | | | |
|---|---|---|---|---|---|
| 448,733 | A | * | 3/1891 | Sagendorph | 52/526 |
| 872,003 | A | * | 11/1907 | Morgan | 52/509 |
| 1,115,866 | A | * | 11/1914 | Reynolds | 52/525 |
| 1,745,631 | A | * | 2/1930 | Mickelson | 52/559 |
| 2,060,618 | A | * | 11/1936 | Honigbaum | 52/526 |
| 2,078,998 | A | * | 5/1937 | Black | 52/526 |
| 2,087,910 | A | * | 7/1937 | Honigbaum | 52/525 |
| 2,087,911 | A | * | 7/1937 | Honigbaum | 52/523 |
| 2,184,655 | A | * | 12/1939 | Spain | 52/526 |
| 2,202,830 | A | * | 6/1940 | Bussey | 52/534 |
| 2,390,348 | A | * | 12/1945 | Black | 52/526 |
| 3,807,113 | A | * | 4/1974 | Turner | 52/314 |
| 4,094,115 | A | * | 6/1978 | Naz | 52/51 |
| 4,648,218 | A | * | 3/1987 | Butzen | 52/96 |
| 4,712,351 | A | * | 12/1987 | Kasprzak | 52/573.1 |
| 5,307,604 | A | | 5/1994 | Tasso | |
| 5,349,802 | A | * | 9/1994 | Kariniemi | 52/543 |
| 5,442,888 | A | * | 8/1995 | Ilnyckyj | 52/524 |
| 5,644,886 | A | * | 7/1997 | Ekmark et al. | 52/518 |
| 5,802,791 | A | * | 9/1998 | Kuntz | 52/394 |
| 5,987,832 | A | * | 11/1999 | Kuntz | 52/394 |

(Continued)

FOREIGN PATENT DOCUMENTS

JP 03235860 A * 10/1991

(Continued)

*Primary Examiner*—Richard E. Chilcot, Jr.
*Assistant Examiner*—Charissa Ahmad
(74) *Attorney, Agent, or Firm*—Shook, Hardy & Bacon, LLP.

(57) ABSTRACT

A roofing member provides improved thermal expansion relief characteristics when mounted adjacent to other roofing members in laterally extending courses on a roof surface. According to one arrangement, the roofing member has a main body with top and bottom surfaces, and side regions, as well as one or more spacer tabs extending outwardly from one or more of the side regions. Each spacer tab extends outwardly from a location on one of the side regions that is adjacent to one of a set of depressions formed into the bottom surface of the main body. In this way, when thermal expansion of adjacently mounted roofing members occurs causing a compressive force to be applied against particular spacer tabs, the spacer tabs fail in a way that at least partially displaces the respective tabs into the adjacently positioned depressions, thereby reducing the stress loads that adjacent shingles apply to one another.

6 Claims, 3 Drawing Sheets

U.S. PATENT DOCUMENTS

| | | | | |
|---|---|---|---|---|
| 6,336,303 | B1 * | 1/2002 | Vandeman et al. | 52/520 |
| 6,939,036 | B2 | 9/2005 | Beck et al. | |
| 2004/0093821 | A1 * | 5/2004 | Taenak et al. | 52/590.2 |
| 2005/0262790 | A1 * | 12/2005 | Turek | 52/518 |

FOREIGN PATENT DOCUMENTS

| | | | |
|---|---|---|---|
| JP | 05280158 | A * | 10/1993 |
| JP | 05280159 | A * | 10/1993 |
| WO | WO 2008052028 | A2 * | 5/2008 |
| WO | WO 2008052029 | A2 * | 5/2008 |

* cited by examiner

ROOFING PRODUCT POSSESSING THERMAL EXPANSION RELIEF CHARACTERISTICS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a roofing product. More specifically, the present invention is directed to a roof covering member possessing thermal expansion relief characteristics.

Roofing shingles are commonly used to provide a protective environmental barrier layer for a pitched roof. These shingles typically include asphalt shingles, non-asphalt engineered composite shingles, wood shake singles, slate shingles, ceramic and concrete tiles and the like. Engineered composite shingles have become popular for commercial and residential installations in recent years due to their high strength and durability, lower cost and maintenance as compared to wood and slate shingles, and relative ease of installation. Because of their composite nature, engineered composite shingles can be fabricated to imitate the look of shake, slate, tile, and many other types of shingles. One particular type of composite shingle employs a material makeup of at least a polymer component and a filler component. For instance, the polymer component may comprise one or more thermoplastic materials and the filler component may comprise one or more minerals, as examples. Coloring agents, UV inhibitors, stabilizers, and other additives may be added or applied to the material makeup to improve the characteristics of the finished shingle product.

When installing a shingled roof covering system on a pitched roof, a starter course, or row, is usually coupled to a roof deck along the eaves to form a base for the first course of full shingles. Additional shingle courses are applied to partially overlap the previous courses as the roofing installer works their way up to the ridgeline.

One particular problem faced by shingle installers is how to account for thermal expansion and contraction cycles that occur when singles are exposed to temperature extremes in the outdoor environment. This is especially problematic when a semi-rigid to rigid shingle has fixed point of attachment on a building roof structure and will become exposed to temperatures that vary greatly from the temperature of the shingle when it is installed on the roof, such a temperature differential being referred to herein as "Delta T". As one example, consider the pair of shingles 100 illustrated in FIG. 1 as positioned adjacent to one another in the same course on a roof deck (not shown). A fastener is inserted through one of a set of nailing zones 102 on the shingle top surface 103 and into the roof deck to rigidly affix the shingle 100 onto a building. Because these shingles 100 have side regions 104 that abut one another when installed, any thermal expansion of the shingles will cause each to expand laterally and the side regions 104 of each shingle to exert a sizeable force on the side region of the adjacent shingle. Moreover, a large Delta T causes a bowing or "pillowing" effect of the shingles 100 where a mid-region of the shingle moves upwardly off of the underlying roof deck. This bowing effect can undermine the attachment of the fasteners extending through the nailing zones 102, potentially causing them to move out of engagement with the roof deck. Additionally, the bowing can leave areas of the underlying roof deck directly exposed to the environment, which could allow precipitation and other elements to infiltrate the structure of the roof. Furthermore, the bowing diminishes the aesthetics of the roofing product.

Therefore, it would be beneficial to provide a roofing product that possesses thermal expansion relief characteristics, particularly for handling situations where the product is exposed to ambient temperatures that vary significantly from the temperatures at product installation.

SUMMARY OF THE INVENTION

Improved roofing system performance is achieved through a roofing member or shingle possessing thermal expansion relief characteristics. In one aspect, the roofing member provides thermal expansion relief when mounted adjacent to other roofing members in laterally extending courses on a roof surface. Specifically, each roofing member has a main body with top and bottom surfaces, and side regions, as well as one or more spacer tabs extending outwardly from one or more of the side regions. Each spacer tabs extends outwardly from a location on one of the side regions that is adjacent to one of a set of depressions formed into the bottom surface of the main body. In this way, when thermal expansion of adjacently mounted roofing members occurs causing a compressive force to be applied against particular spacer tabs, the particular spacer tabs fail in a way that at least partially displaces the respective spacer tabs into the adjacently positioned depressions, thereby reducing the stress loads that adjacent shingles apply to one another.

In another aspect, the spacer tabs and corresponding adjacent depressions are configured to handle a first compressive thermal expansion load where the spacer tabs are partially displaced into the corresponding depressions and a second compressive thermal expansion load where the spacer tabs are fully displaced into the corresponding depressions. In this way, the first compressive thermal expansion load can be said to cause a first mode of failure, while the second compressive thermal expansion load can be said to cause a second mode of failure.

The invention of another aspect takes the form a roofing member having a main body, a cutout feature, and a spacer tab feature. Specifically, the main body includes top and bottom surfaces, and side regions, with the cutout feature formed into one or more of the side regions and spacer tab feature extending outwardly from at least one of the side regions proximal to the respective cutout feature. In this way, when thermal expansion of adjacently mounted roofing members occurs causing a compressive force to be applied against the spacer tab feature inwardly with respect to one or more of the side regions, the cutout feature and the spacer tab feature cooperatively provide stress relief through movement of the spacer tab feature at least partially into the cutout feature.

Additional advantages and novel features of the present invention will in part be set forth in the description that follows or become apparent to those who consider the attached figures or practice the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

The present invention provides a roofing system formed by roofing members or shingles possessing thermal expansion relief characteristics. The roofing system provides a degree of "play" between adjacently mounted shingles on a roof structure. Specifically, as the shingles expand in size due to the temperature of the shingles becoming elevated, spacer tabs which are typically utilized to properly align and space apart shingles for installation are allowed to be displaced inwardly into the side regions of the shingles. This allows the side regions of the shingles to avoid the high compressive loads applied by thermally expanding adjacent shingles. In certain embodiments, the spacer tabs are configured to substantially only undergo elastic deformation when thermal expansion occurs, while in other embodiments, certain modes of failure result in the spacer tabs partially or fully breaking away from connection with the side regions of the respective shingle.

Figure 1:
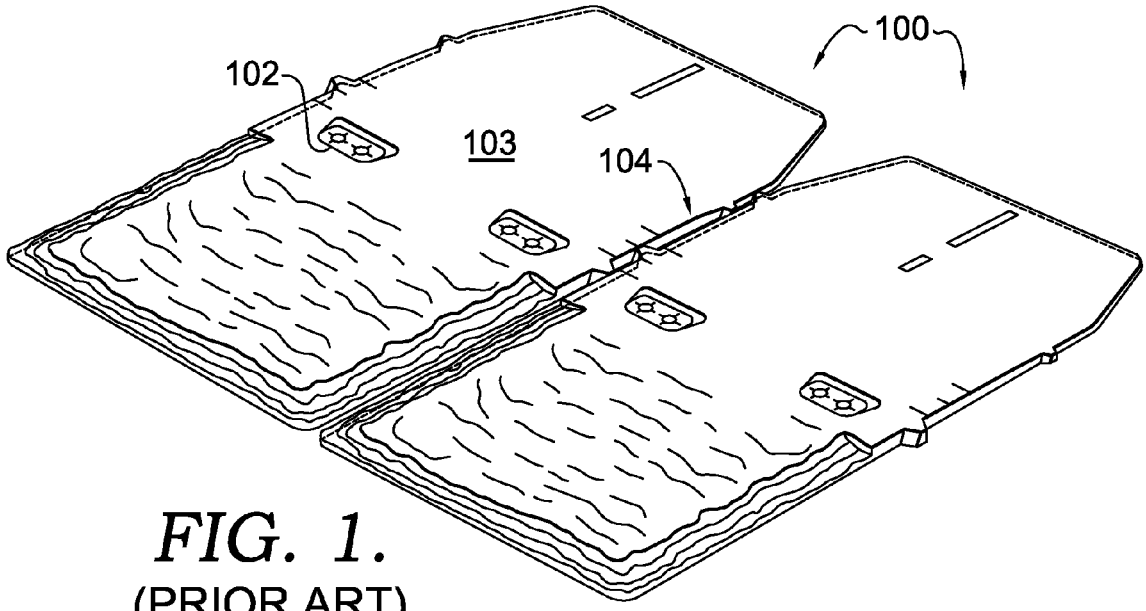
FIG. 1. (PRIOR ART)
FIG. 1 is a top perspective view of prior art shingles aligned in a shingle course.
Figure 2:
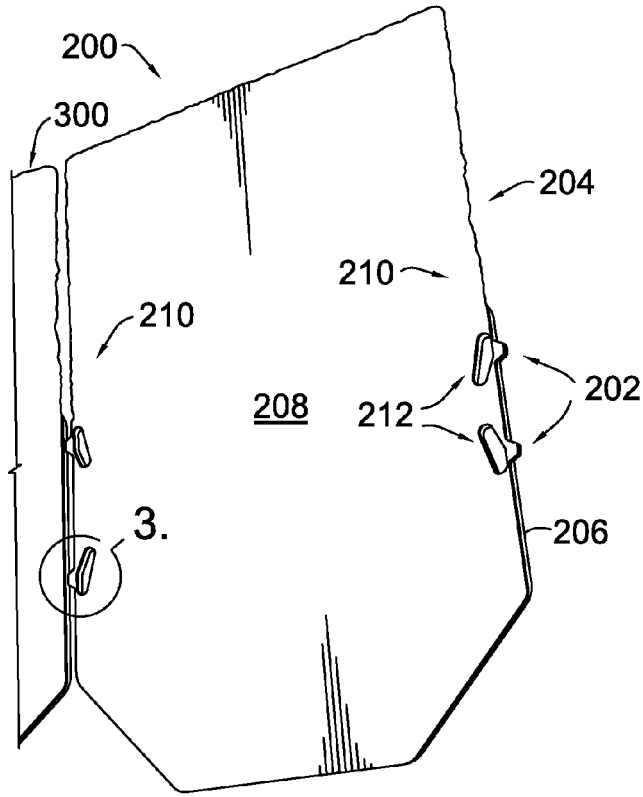
FIG. 2 is a bottom perspective view of one embodiment of a roofing member of the present invention possessing thermal expansion relief characteristics depicted in an abutting relationship with an adjacent roofing member.

Turning to FIGS. 2-6, an embodiment of a shingle 200 possessing thermal expansion relief characteristics is depicted with a spacer tab feature 202 abutting an adjacent shingle 300. The shingle 200 has a main body 204 possessing a top surface 206, a bottom surface 208, and side regions 210 from which the spacer tab feature 202 extends. It should be understood that the shingle top surface 206 may take the same form as the top surface 103 of the prior art shingle 100 of FIG. 1, or any other form desired. The spacer tab feature 202 extends laterally outwardly from the side regions 210 adjacent to a depression feature 212 formed in the bottom surface 208 of the shingle 200. As used herein, the term "spaced tab feature" refers to one or more individual spacer tabs 214 each located on one of the shingle side regions 210. Similarly, the term "depression feature" refers to one or more individual depressions 216 or cavities each corresponding to one of the individual spacer tabs 214.

Figure 3:
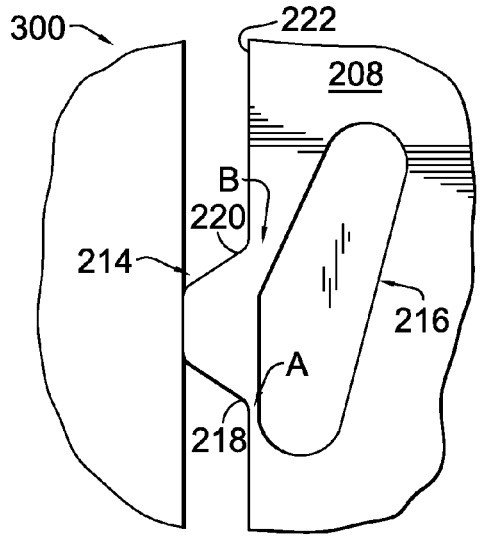
FIG. 3 is a close-up plan view of the roofing member generally in a region identified by the circled area in FIG. 2, showing a spacer tab and a corresponding depression.

Each spacer tab 214 has a first longitudinal end 218 and a second longitudinal end 220 moving in the longitudinal direction of a sidewall 222 of the side regions 210. Each depression 216 is preferably located relative to the shingle sidewall and to one of the corresponding spacer tabs 214 such that the sidewall 222 is formed with a first smaller wall thickness at a location A directly between the depression 216 and the spacer tab first longitudinal end 218 and is formed with a second larger wall thickness at a location B directly between the depression 216 and the spacer tab second longitudinal end 220, as seen in FIG. 3. This design serves the purpose of creating a weak point in the sidewall 222 webbing at location A to control the initial structural failure mode of the sidewall 222 as the compression force due to thermal expansion of an adjacent shingle 300 increases against the spacer tab 214. At the initial failure mode, depicted in FIG. 4, the spacer tab 214 cantilevers into a first region 224 of the depression 216 while remaining attached to the sidewall 222 generally at location B. Specifically, the first longitudinal end 218 moves into contact with a depression sidewall 226 in the first region 224 while a portion of the spacer tab 214 remains outside of the depression 216 and extends outwardly from the plane of the sidewall 222 to remain in contact with the adjacent shingle 300. Thus, the initial failure mode provides displacement of the spacer tab 214 laterally into the shingle main body 204 without completely disconnecting with the shingle sidewall 222.

Figure 6:
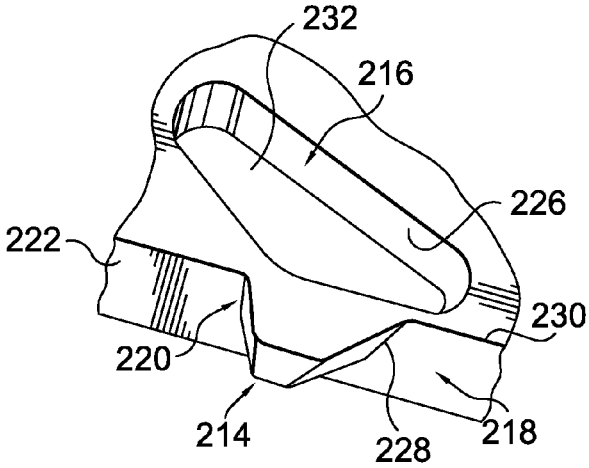
FIG. 6 is a perspective view of the roofing member region depicted in FIG. 3.

As can be seen in FIG. 6, the first longitudinal end 218 of the spacer tab 214 has a sloped intersecting edge 228 with the shingle sidewall 222. This slope provides a tapered length for the spacer tab 214 longitudinally along the sidewall 222 such that the spacer tab length increases moving in the direction of the shingle bottom surface 208. The sloped intersecting edge 228 aids in guiding the initial failure mode at location A on the sidewall 222 webbing so that the spacer tab 214 laterally pivots directly into the depression 216 without pivoting upwardly or downwardly towards the shingle top surface 206 or bottom surface 208. If the sloped edge 228 were instead vertically aligned and perpendicular to an intersecting edge 230 of the bottom surface 208 and the sidewall 222 of the shingle 200, the extra material strength added by a surface webbing 232 of the shingle main body 204 above the depression 216 would cause uneven failure of the sidewall 222 near the spacer tab first longitudinal end 218, and thus undesirable upward or downward pivoting of the spacer tab 214.

Figure 4:
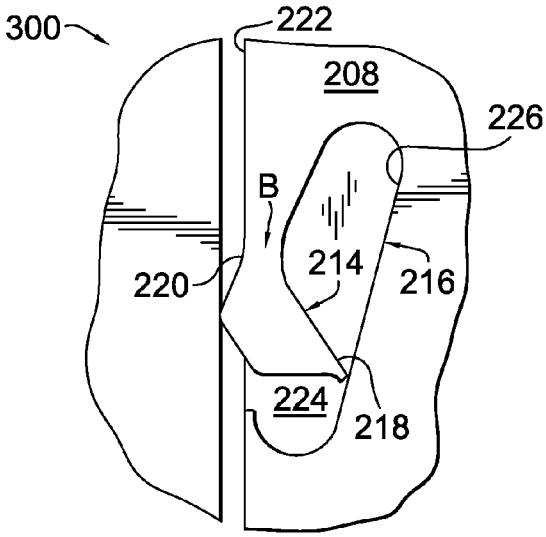
FIG. 4 is a view similar to FIG. 3, with the spacer tab being partially displaced into the depression due to a compressive force being applied by the adjacent roofing member.
Figure 5:
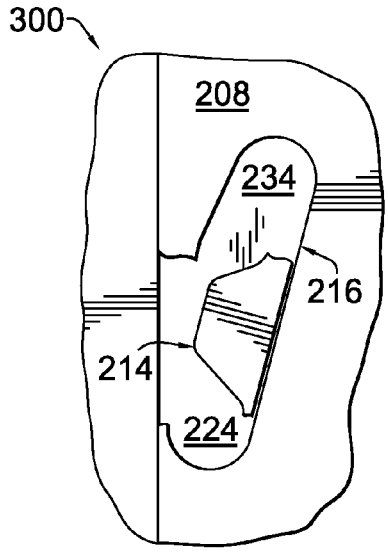
FIG. 5 is a view similar to FIG. 3, with the spacer tab being fully displaced into the depression due to a compressive force being applied by the adjacent roofing member.

With reference to FIGS. 4 and 5, as the shingles 200, 300 continue in thermal expansion beyond the point where the initial failure mode depicted in FIG. 4 occurs, such as on a hot day with significant sun exposure, the compressive forces on the spacer tab 214 are transferred to the shingle main body 204, specifically to the depression sidewall 226 and to the shingle sidewall 222 in the region of location B. Continued expansion beyond this point causes a second structural failure mode depicted in FIG. 5. Specifically, the second longitudinal end 220 of the spacer tab will break away from the shingle sidewall 222 at location B, causing the adjacent shingle 300 to push the spacer tab 214 into the depression 216 beyond the first region 224 and into a retaining region 234 of the depression 216. In this way, the depression 216 both serves to control the failure modes of the spacer tab 214 and compression loads that are transferred to the shingle main body 204 over a range of thermal expansion of adjacently mounted shingles, as well as serving as a retainer for the spacer tab 214 that has broken away from the shingle sidewall 222. The particular depth of the depressions 216 measured along the sidewall 226 perpendicularly to the plane of the shingle bottom surface 208 is a matter of design choice, and in one embodiment, is at least as large as the height of the spacer tabs 214, enabling the depressions 216 to accept the spacer tabs 214 therein when the shingle bottom surface 208 rests on top of a flat roof structure and the spacer tabs 214 experience an inwardly compressive load that results in the initial and second failure modes described herein.

Figure 7:
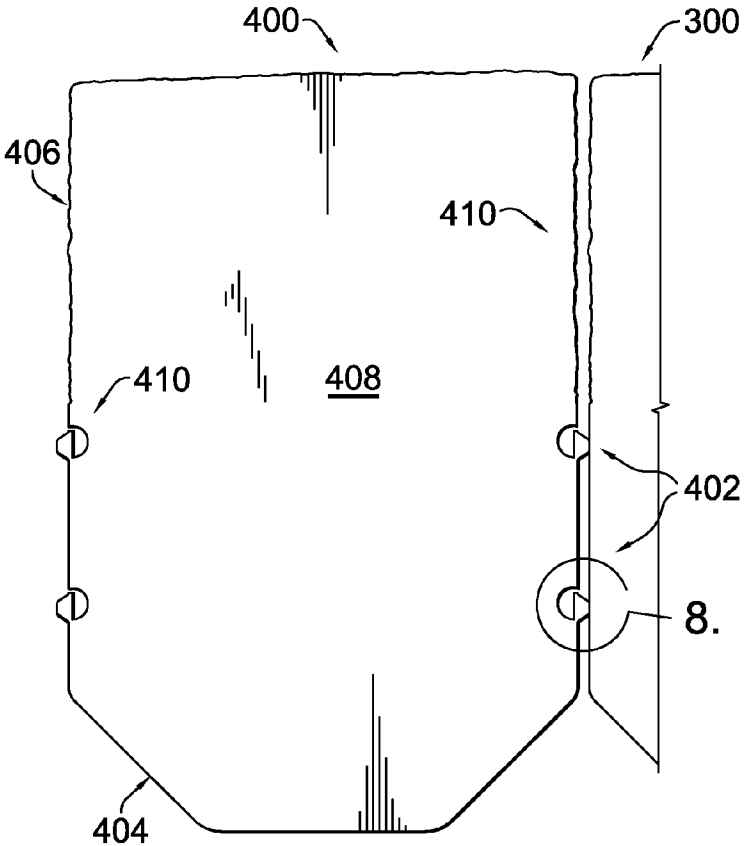
FIG. 7 is a bottom plan view of another embodiment of a roofing member of the present invention possessing thermal expansion relief characteristics depicted in an abutting relationship with an adjacent roofing member.
Figure 8:
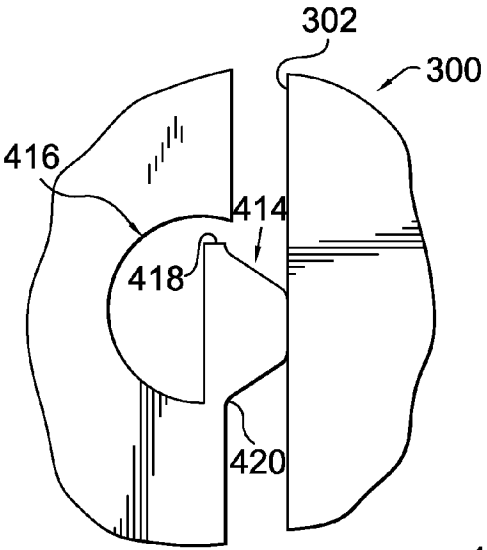
FIG. 8 is a close-up plan view of the roofing member generally in a region identified by the circled area in FIG. 7, showing a spacer tab and a corresponding cutout.
Figure 9:
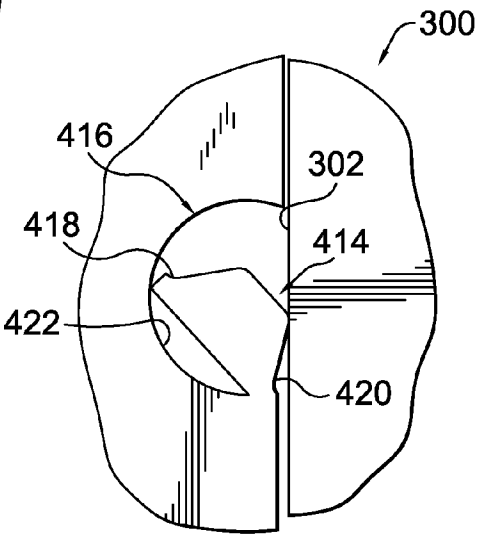
FIG. 9 is a view similar to FIG. 8, with the spacer tab being partially displaced into the cutout due to a compressive force being applied by the adjacent roofing member.

Turning to FIGS. 7-9, another embodiment of a shingle 400 possessing thermal expansion relief characteristics is depicted with a spacer tab feature 402 abutting the adjacent shingle 300. In a similar form to the embodiment of the shingle 200 illustrated in FIGS. 2-6, shingle 400 has a main body 404 possessing a top surface 406, a bottom surface 408, and side regions 410 from which the spacer tab feature 402 extends. The shingle top surface 406 may take the same form as the top surface 103 of the prior art shingle 100 of FIG. 1, or any other form desired. The spacer tab feature 402 extends laterally outwardly from the side regions 410 adjacent to a cutout feature 412 formed in at least one of the side regions 410 and preferably extends from the top surface 406 through the main body 404 to the bottom surface 408. As with the embodiment of shingle 200 illustrated in FIGS. 2-6, the term "spaced tab feature", as used herein, refers to one or more individual spacer tabs 414 each located on one of the shingle side regions 210. Similarly, the term "cutout feature" refers to one or more individual cutouts 416 each corresponding to one of the individual spacer tabs 414.

Each spacer tab 414 has a free end 418 and a fixed end 420, with the fixed end 420 configured to provide resistance to the compression force provided by a sidewall 302 of the adjacent shingle 300 undergoing thermal expansion. The thickness of the spacer tab 414 at the fixed end 420 is ideally sufficient to resist laterally inward deflection of the tab 414 when being contacted by the sidewall 302 of an adjacent shingle 300 at the time of installation, but of a thickness that allows the tab 414 to elastically deflect as the compressive loads on the tab 414 provided by the thermally expanding adjacent shingle increase to prevent bowing of the shingle 400 and adjacent shingle 300.

As seen in FIG. 9, as the compressive load applied to the spacer tab 414 increases by the sidewall 302 of the adjacent shingle 300, the tab 414 continues to deflect into the corresponding cutout 416 until the free end 418 of the tab 414 contacts an inner wall 422 of the cutout 416. Ideally, the spacer tab 414 and the corresponding cutout 416 are sized and configured to enable a sufficient amount of rotation of the spacer tab 414 into the cutout 416 to handle the expected range of thermal expansion of the shingles 300, 400. The spacer tab 414 may optionally be configured to eventually undergo structural failure at the fixed end 420 if thermal expansion continues beyond the condition depicted in FIG. 9. Alternatively, the spacer tab 414 may be configured to avoid such failure, and instead resiliently return to the position depicted in FIG. 8 when temperatures of the shingles 300, 400 have lowered from the temperatures at which significant or maximum thermal expansion takes place.

It should be understood that the adjacent shingle 300 described herein may take the form of shingle 200 of FIGS. 2-6 or shingle 400 of FIGS. 7-9, such that all shingles in a given installed course possess the thermal expansion relief characteristics described herein. Alternatively, shingle courses may be installed utilizing rows of shingles that have only some of the shingles in the given row possessing the thermal expansion relief characteristics of shingles 200 and/or 400. As one example, a given row may alternate single 200 or shingle 400 with an adjacent shingle 300 lacking at least the depression feature 212, and optionally the spacer tab feature 202.

The shingles 200 and 400 of the present invention are preferably formed from composite materials. Suitable materials include, but are not limited to, rubber (e.g., ground up tire rubber), polymers such as polyolefins (e.g., various grades of polyethylene, recycled or virgin), fillers (e.g., glass, stone, limestone, talc, mica, cellulosic materials such as wood flour, rice hulls, etc.), asphalt embedded mats, or tile. In one embodiment, the composite material makeup includes at least a polymer component and a filler component. Coloring agents may also be added to the mixture so that the composite product more closely resembles a particular type of shingle. For example, for a composite slate product, a gray color may be added to the mixture. Similarly, for a composite wood shake product, a brown color may be added to the mixture. Other additives or processing methods may be added or applied to improve reflection, heat deflection or other weathering characteristics, (e.g., UV inhibitors and stabilizers). These material combinations form the shingles 200 and 400 into semi-rigid objects.

The shingles 200 and 400 may be made and cut, or molded, to shape using various fabrication techniques. For example, one manner of making the starter block relies on the use of a mixer and extruder. The ingredients that are used to form the starter block are mixed in the mixer (e.g., a kinetic mixer) and then passed through the extruder. The mixture emerging from the extruder may be sliced into small pellets by a rotary knife so that the material can be more easily conveyed through piping under air pressure or suction to a storage location for use when needed (e.g., in a storage bin). Thereafter, the pellets are extracted from storage and fed to an injection-molding machine along with coloring agents where the material is injected in one or more molds that have been cast or machined, such as by digitized molding, to have the desired shape of the shingle. After curing and sufficient cooling, the molded shingle is removed from the mold and bundled or otherwise packaged with like shingles for shipment or storage.

As can be seen, the shingles 200, 400 of the present invention provide a roofing system with thermal expansion relief characteristics to reduce the compressive loads induced by adjacent shingles on one another. While particular embodiments of the invention have been shown, it will be understood, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A roofing member having thermal expansion relief capabilities when mounted onto a roof surface in laterally extending courses, comprising:

a main body having side regions, a top surface and a bottom surface, wherein the bottom surface is formed with one or more depressions each positioned proximal to one of the side regions; and one or more spacer tabs each extending outwardly from at least one of the side regions of the main body adjacent to one depression of the one or more depressions;

wherein a compressive force against a particular one of the spacer tabs of the roofing member caused by thermal expansion of an adjacent roofing member when such roofing members are both mounted in the same course causes failure of the respective main body side region at a location adjacent to the particular spacer tab of the roofing member such that the particular spacer tab is at least partially displaced into one of the depressions adjacent to the particular spacer tab, wherein the one or more spacer tabs and the respective adjacent one or more depressions are configured such that failure of the respective main body side region at a location adjacent to the particular spacer tab resulting from the compressive force against the particular spacer tab occurs as a first mode of failure whereby the particular spacer tab cantilevers into the respective depression, and wherein the failure of the respective main body side region at a location adjacent to the particular spacer tab resulting from the compressive force against the particular spacer tab further occurs as a second mode of failure whereby the particular spacer tab fully separates from the main body and is displaced inwardly from the position of the spacer tab at the first mode of failure.

2. The roofing member of claim 1, wherein the one or more spacer tabs and the respective adjacent one or more depressions are configured such that a first compressive force against a particular one of the spacer tabs of the roofing member causes the particular spacer tab to be partially displaced into the respective depression adjacent to the particular spacer tab and a second compressive force against the particular spacer tab causes the particular spacer tab to be fully displaced into the respective depression adjacent to the particular spacer tab.

3. A roofing member, comprising:

a main body having side regions, a top surface and a bottom surface, wherein the bottom surface is formed with a depression feature positioned proximal to at least one of the side regions; and a spacer tab feature extending outwardly from at least one of the side regions of the main body adjacent to the depression feature;

wherein the spacer tab feature and the depression feature cooperatively provide stress relief through movement of the spacer tab feature at least partially into the depression feature upon a sufficient lateral compressive force being applied to the spacer tab feature inwardly with respect to one of the side regions of the main body, wherein the depression feature is configured to form a first wall thickness between a first portion of the depression feature and the respective main body side region positioned proximally thereto at a first longitudinal end of the spacer tab feature, and a second wall thickness between a second portion of the depression feature and the respective main body side region positioned proximally thereto at a second longitudinal end of the spacer tab feature, enabling the stress relief movement of the spacer tab feature to result from failure of the first wall thickness upon the compressive force being directed inwardly in the transverse direction, and wherein the first longitudinal end of the spacer tab feature presents a sloped intersection edge with the respective main body side region to form an increasing longitudinal dimension for the spacer tab feature moving in the direction of the main body bottom surface.

4. The roofing member of claim 3, wherein the depression feature is configured to fully receive the spacer tab feature upon a second sufficient compressive force being applied to the spacer tab feature inwardly with respect to one of the side regions of the main body.

5. The roofing member of claim 3, wherein the main body has a pair of side regions and the depression feature is positioned proximal to both of the side regions, and wherein the spacer tab feature extends outwardly from both of the side regions.

6. The roofing member of claim 3, wherein each of the side regions form a sidewall, and the spacer tab feature extends outwardly from each of the sidewalls.

* * * * *